US005671901A

United States Patent [19]

Jacober

[11] Patent Number: 5,671,901

[45] Date of Patent: Sep. 30, 1997

[54] PAGE HOLDING APPARATUS AND METHOD

[76] Inventor: Robert L. Jacober, 12130 SW. 107th Ave., Miami, Fla. 33176

[21] Appl. No.: 553,924

[22] Filed: Nov. 6, 1995

[51] Int. Cl.[6] ..... A47B 97/04

[52] U.S. Cl. ..... 248/452; 248/457; 248/460

[58] Field of Search ..... 248/452, 457, 248/454, 460, 441.1, 451; 40/341; 281/45

[56] References Cited

U.S. PATENT DOCUMENTS

| | | | |
|---|---|---|---|
| 2,092,665 | 9/1937 | Davis | 248/447 |
| 3,952,989 | 4/1976 | Bannister Hatcher | 248/452 X |
| 4,044,980 | 8/1977 | Cummins | 248/460 X |
| 4,150,807 | 4/1979 | Manso | 248/452 |
| 5,253,840 | 10/1993 | Sheremetta | 248/452 |

*Primary Examiner*—Ramon O. Ramirez

*Attorney, Agent, or Firm*—Robert J. Van DerWall

[57] ABSTRACT

A holder apparatus for propping and holding a printed item for viewing includes a printed item support member having a support member forward edge, a support member rearward edge and a support member upper face; a hinge; a base member having a base member forward edge, for resting on an apparatus support surface, where the base member forward edge is connected by the hinge to the support member forward edge; a biasing structure extending between the support member and the base member for elevating the support member rearward edge to tilt the support member upper face toward a user of the apparatus; a post member secured to the base member and extending upwardly behind the support member; and an anchor arm member slidably mounted on the post member for pressing downwardly against and thereby holding a page of the printed item. Methods of apparatus disassembly, assembly and use are also provided.

12 Claims, 4 Drawing Sheets

PAGE HOLDING APPARATUS AND METHOD

BACKGROUND OF THE INVENTION

1. Field of the Invention

The present invention relates generally to the field of devices for propping and holding books and papers to present their contents for viewing. More specifically the present invention relates to a holder apparatus for propping and holding open a book or other printed item and for sequentially securing individual pages of the item in a convenient line of sight for an apparatus user. The holder apparatus includes a base panel and a printed item support panel, these panels being interconnected at their forward edges with hinges. The base panel rests substantially horizontally on an apparatus support surface. The upper face of the support panel is tilted toward the user as a result of the rearward edge of the support panel being elevated by spring elements mounted between the base and support panels. A printed item retaining rib is preferably provided along the forward edge of the support panel upper face, to prevent the printed item from sliding off the support panel. Post members are secured to the rearward portion of the base panel and extend upwardly to a point above the maximum height of the support panel rearward edge. An anchor arm member is secured to each post member for holding a page of the printed item open.

Each anchor arm member preferably has an annular portion for slidingly fitting over a post member and an anchor arm portion for extending over the support panel. A thumb set screw extends through a radial threaded bore in each anchor arm member annular portion for securing the anchor arm member to a post member when the arm member is positioned over or away from a printed item. The remote ends of the anchor arm portions preferably each include an anchor arm finger portion protruding downwardly for bearing against an open page of a printed item to hold a printed item and page in place. The finger portions reach below the level of the elevated rearward edge of the support panel to hold a single page or a thin book as securely as a thick book.

Two post members and anchor arm members are provided to hold down both pages of an open book. The spring elements are preferably two coil springs which are each fitted onto pegs projecting upwardly from the base panel and downwardly from the support panel. The apparatus is preferably made of wood, although many other materials such as various plastics and metals are contemplated.

A method of disassembling the apparatus for storage is provided, including the steps of loosening the thumb set screws and rotating the arm portions of the arm members off the support panel; pivoting the support panel upwardly; pulling the springs off the support panel and base panel pegs; laying the springs flat onto the base panel adjacent the pegs; pivoting the support panel downwardly so that the support panel rests on the pegs, rotating the anchor arm portions over the support panel and sliding the anchor arm members downward so that the finger portions abut the support panel; tightening the thumb set screws so that the finger portions hold the apparatus in a collapsed storage position.

A method of assembling the apparatus for use is provided, including the steps of loosening the thumb set screws and rotating the anchor arm portions off the support panel; pivoting the support panel upward; fitting one end of each spring onto a base panel peg and the other end onto a corresponding support panel peg; sliding the anchor arm members upwardly; and rotating the arm portions over the support panel.

A method of using the assembled apparatus is also provided, including the steps of placing a printed item onto the support panel; pressing downward on the printed item to pivot the support panel downwardly against the biasing of the springs; sliding the printed item underneath the anchor arm finger portions; releasing the printed item so that the springs pivot the support panel upwardly and press the printed item against the anchor arm finger portions. A page is turned by pressing downward on the printed item to pivot the support panel downwardly and free the printed item from the anchor arm finger portions; sliding the printed item out from under the anchor arm finger portions; turning the page; sliding the printed item back underneath the anchor arm finger portions; and releasing the downward pressure on the printed item so that the springs push the support panel upwardly and press the printed item into contact with the finger portions.

2. Description of the Prior Art

There have long been mechanisms for holding pages in books open for reading which free the hands of the user. These mechanisms have most often been developed at the spur of the moment by the individual user, and have included placing paper weights on open pages and joining open pages to pages behind them with paper clips. The paper weights can obstruct substantial portions of the open page and are subject to sliding off the page. Paper clips can crease and tear pages. Neither approach angles the book into a convenient line of sight for the user.

It is thus an object of the present invention to provide a display holder apparatus which holds printed items such as books, pamphlets and single sheets or pages open and positioned for direct and convenient viewing.

It is another object of the present invention to provide such a holder apparatus which can be partly dismantled and collapsed quickly and easily for compact storage and transport.

It is still another object of the present invention to provide such a holder apparatus which does not mar or otherwise damage the printed item.

It is finally an object of the present invention to provide such a holder apparatus which is simple in design, sturdy and economical to manufacture.

SUMMARY OF THE INVENTION

The present invention accomplishes the above-stated objectives, as well as others, as may be determined by a fair reading and interpretation of the entire specification.

A holder apparatus is provided for propping and holding a printed item for viewing, including a printed item support member having a support member forward edge, a support member rearward edge and a support member upper face; a hinge; a base member having a base member forward edge, for resting on an apparatus support surface, where the base member forward edge is connected by the hinge to the support member forward edge; a biasing structure extending between the support member and the base member for elevating the support member rearward edge to tilt the support member upper face toward a user of the apparatus; a post member secured to the base member and extending upwardly behind the support member; and an anchor arm member slidably mounted on the post member for pressing downwardly against and thereby holding a page of the printed item. The apparatus preferably includes two post members and one anchor arm member slidably mounted on each post member. The arm members each preferably include an annular portion for slidingly fitting over the post member and an arm portion extending generally radially from the annular portion and over the support member for bearing down against and holding a printed item in place on the support member. The arm member has a free end which preferably includes an anchor arm finger portion protruding downwardly to bear against an open page of the printed item. The support member preferably includes a spring mounting support member peg protruding downwardly and the base member includes a spring mounting base member peg protruding upwardly, and the biasing structure preferably includes a coil spring having two spring ends, and each spring end is fitted over one of the peg members. The apparatus preferably includes a printed item retaining element protruding generally upwardly along the support member forward edge for obstructing the printed item from sliding off the support member. The arm member annular portion preferably includes a radial bore having bore internal threads and a thumb set screw extending engagingly through the radial bore for securing the anchor arm member to the post member after the arm member is positioned by a user. The apparatus is optionally made of wood.

A method of assembling the above apparatus is provided, including the steps of loosening the thumb set screws and rotating the arm portions of the arm members off the support member; pivoting the support member upwardly; pulling the spring off the support member peg and the base member peg; laying the spring flat onto the base member; pivoting the support member downwardly so that the pegs abut the members; rotating the anchor arm portion over the support member and sliding the anchor arm member downwardly so that the finger portion abuts the support member; and tightening the thumb set screws so that the finger portions hold the apparatus in a collapsed configuration.

A method of disassembling the above apparatus for storage and transport is provided, including the steps of loosening the thumb set screws and rotating the anchor arm portions off the support member; pivoting the support member upwardly; fitting one end of the spring onto the base member peg and fitting the other end of the spring onto the support member peg; sliding the anchor arm member upwardly; and rotating the arm portion over the support member.

A method of using the above apparatus is provided, including the steps of placing a printed item onto the support member; pressing downward on the printed item to pivot the support member downward against the biasing of the biasing structure; sliding the printed item underneath the anchor arm portion; releasing the printed item so that the biasing structure pivots the support member upwardly and the printed item is pressed against the anchor arm portion.

A method of turning a page of a printed item on the above printed item holding apparatus is provided, including the steps of pressing downward on the printed item to pivot the support member downward against the biasing of the biasing structure and free the printed item from the anchor arm member; sliding the printed item out from under the anchor arm member; turning the page; sliding the printed item back underneath the anchor arm member; and releasing the downward pressure on the printed item so that the springs push the support member upward and press the printed item into contact with the anchor arm member.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
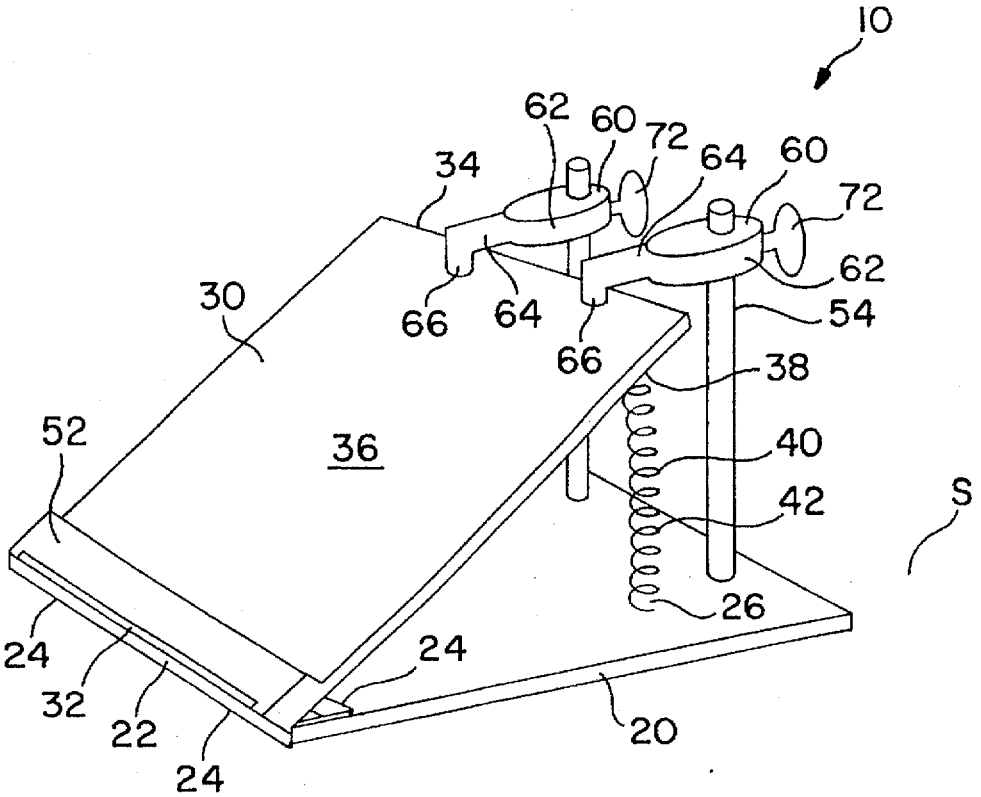
FIG. 1 is a perspective view of the preferred embodiment of the inventive holder apparatus assembled for use.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

First Preferred Embodiment

Figure 2:
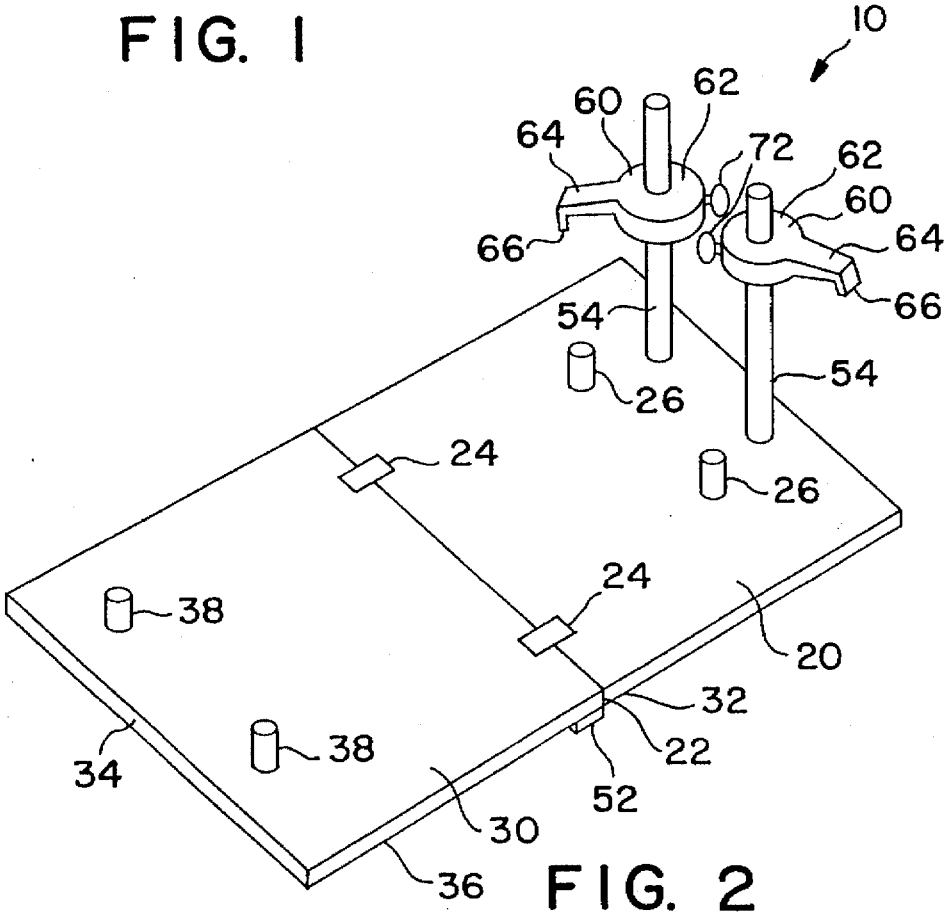
FIG. 2 is a perspective view of the apparatus of FIG. 1 showing the support panel pivoted completely open and the springs removed, to reveal the spring mounting peg arrangement.
Figure 3:
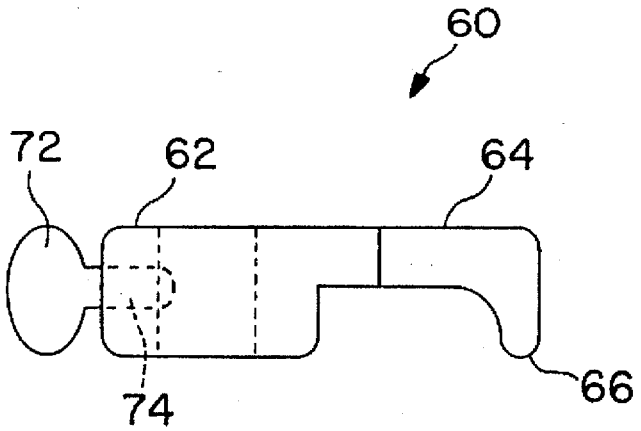
FIG. 3 is a side view of the preferred anchor arm member, revealing the thumb set screw, the threaded radial bore and interior of the annular portion in broken lines, and the finger portion protruding at the free end of the arm portion.
Figure 4:
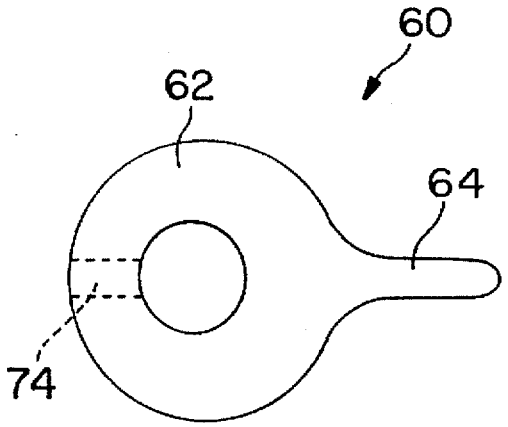
FIG. 4 is a top view of the anchor arm member of FIG. 3, with the threaded radial bore shown in broken lines.
Figure 5:
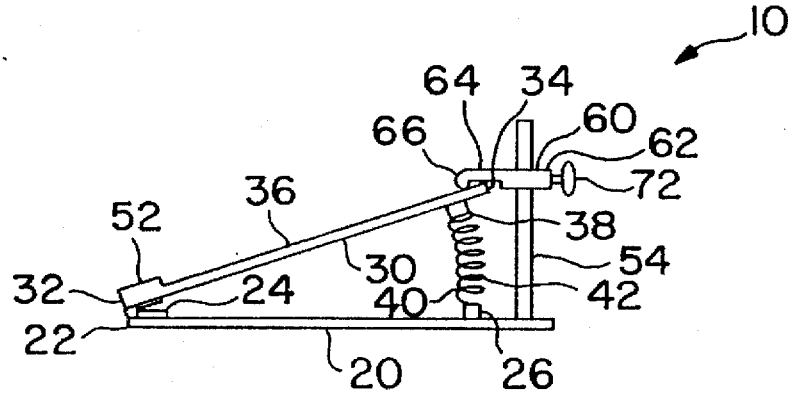
FIG. 5 is a side view of the assembled apparatus.
Figure 6:
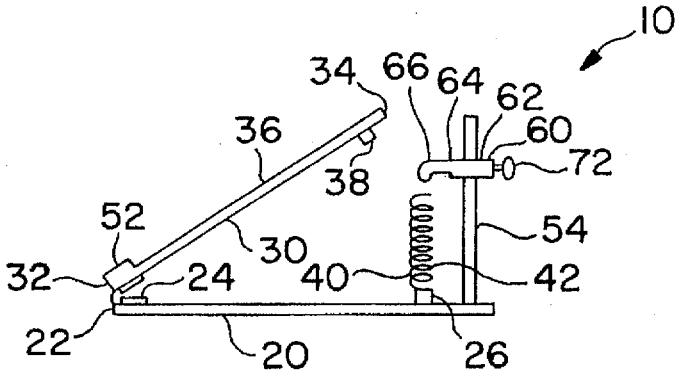
FIG. 6 is a side view as in FIG. 5 with the support panel pivoted upwardly so that the support panel pegs are lifted out of the springs.
Figure 7:
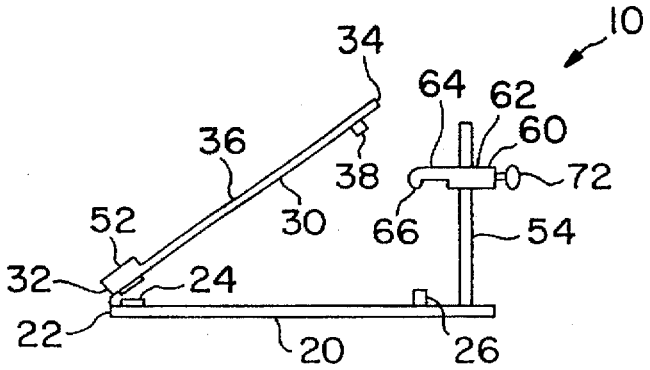
FIG. 7 is a side view as in FIG. 6, with the springs removed entirely.
Figure 8:
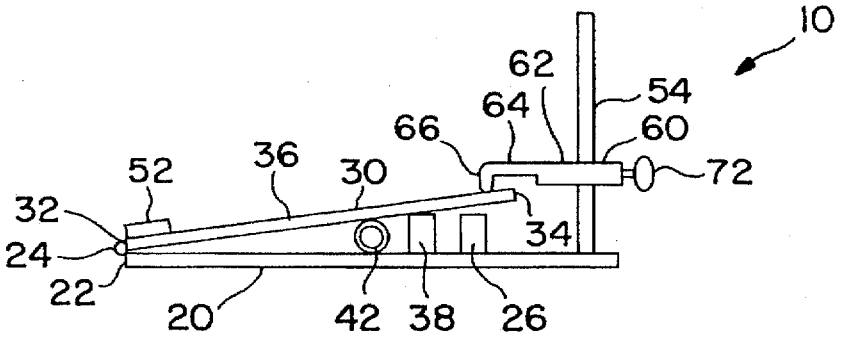
FIG. 8 is a side view as in FIG. 7, with the support panel tilted downwardly into the collapsed, and the arm members slid down and against the support panel, so that the apparatus assumes a compact storage configuration.

Referring to FIGS. 1–2, a holder apparatus 10 is disclosed for propping and holding open a book or other printed item 12 and for securing pages 14 of the item 12 to be viewed. Holder apparatus 10 preferably includes a base panel 20 having a forward edge 22 and a support panel 30 having a forward edge 32, and hinges 24 pivotally interconnecting forward edges 22 and 32. Base panel 20 rests generally horizontally on an apparatus support surface S while the rearward edge 34 of support panel 30 is elevated by spring elements 40 mounted between base panel 20 and support panel 30 so that the upper face 36 of support panel 30 is tilted toward a user. Spring elements 40 are preferably two coil springs 42 which are each fitted snugly over pegs 26 projecting upwardly from base panel 20 and pegs 38 projecting downwardly from support panel 30. A printed item retaining rib 52 is preferably provided along support panel forward edge 32 on upper face 36, to prevent the printed item 12 from sliding off support panel 30. Two post members 54 are secured to a rearward portion of base panel 20 and extend upwardly to a point above the maximum height of the rearward edge 34 of support panel 30. An arm member 60 is secured on each post member 54 for holding a page 14 of printed item 12 open. See FIGS. 3 and 4. Each arm member 60 preferably has an annular portion 62 for slidingly fitting over a post member 54 and an arm portion 64 extending over support panel 30 for bearing down against support panel 30 to hold a printed item 12 and page 14 in place. The free ends of arm portions 64 each preferably include an arm finger portion 66 protruding downwardly to bear against an open page 14 of a printed item 12. Finger portions 66 reach below the level of elevated rearward edge 34 of support panel 30 to hold a single page 14 or a thin book 12, as well as a thick book.

A thumb set screw 72 extends through a radial threaded bore 74 in each anchor arm annular portion 62 for securing the arm member 60 to a post member 54 when the arm member 60 is positioned over or away from a printed item 12. Apparatus 10 is preferably made of wood, although many other materials such as various plastics and metals are contemplated and known to be suitable.

Method of Disassembly for Storage

In practicing the invention, the following method may be used. See FIGS. 5–8. A method of disassembling apparatus 10 for storage is provided, including the steps of loosening thumb set screws 72 and rotating arm portions 64 of arm members 60 off support panel 30; pivoting support panel 30 upwardly on hinges 24; pulling springs 42 off the support panel 30 and base panel pegs 26; laying springs 42 flat onto base panel 20 adjacent pegs 26 and 38; pivoting support panel 30 downwardly on hinges 24 so that support panel 30 rests on pegs 26 or 38; rotating arm portions 64 over support panel 30 and sliding arm members 60 downward so that finger portions 66 abut support panel 30; tightening thumb set screws 72 so that the finger portions 66 hold apparatus 10 in a collapsed, compact storage position.

Method of Assembly for Storage

A method of assembling apparatus 10 for storage is provided, including the steps of loosening thumb set screws 72 and rotating arm portions 64 off support panel 30; pivoting support panel 30 upwardly on hinges 24; fitting one end of each spring 42 onto a base panel peg 26 and other onto a support panel peg 38; sliding arm members 60 upwardly; and rotating arm portions 64 over support panel 30. See FIGS. 5–8 in reverse order.

Methods of Use

Figure 9:
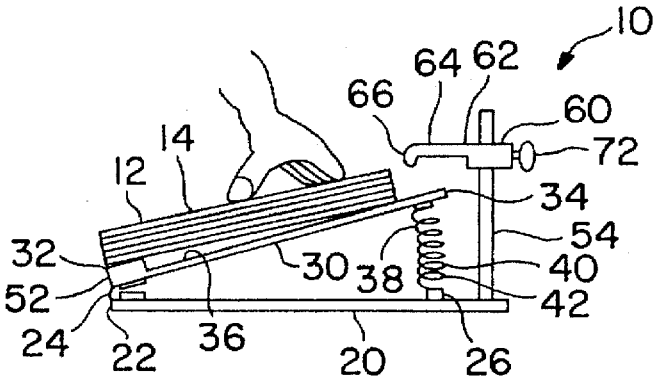
FIG. 9 is a side view of the apparatus with an open book on the upper face of the support panel and on top of the retaining rib, with the book and support panel pressed downward against the biasing of the springs by the hand of a user.
Figure 10:
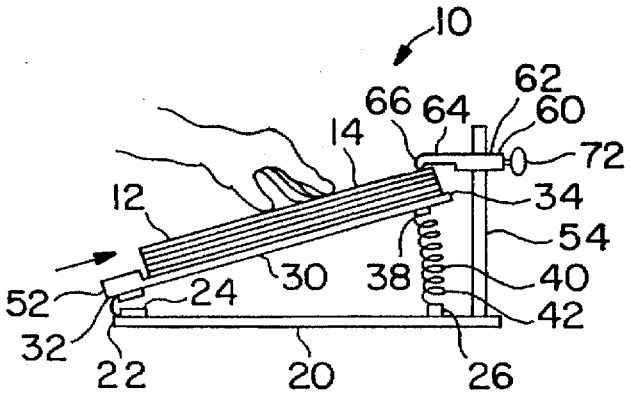
FIG. 10 is a view as in FIG. 9, with the open book slid up the support panel, over the retaining rib and underneath the arm member finger portions.
Figure 11:
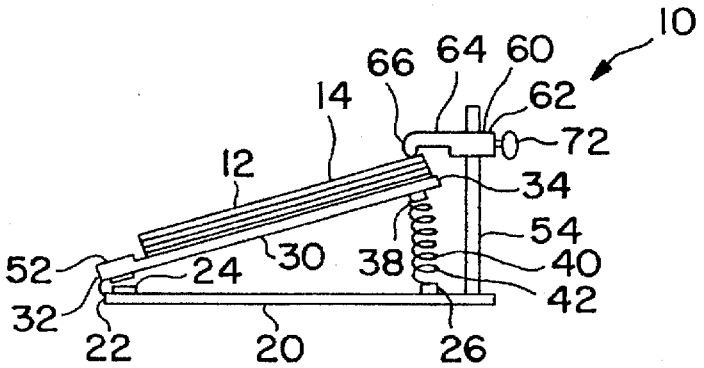
FIG. 11 is a view as in FIG. 10, with the open book and support panel released and pressed by the springs against the finger portions of the arm members to hold the book open and the open pages in place.

Methods of using the assembled apparatus 10 are also provided. See FIGS. 9–11. This method includes the steps of placing a printed item 12 onto support panel 30; pressing downward on printed item 12 to pivot support panel 30 downwardly on hinges 24 against the biasing of springs 42; sliding the printed item 12 underneath arm portions 64; releasing printed item 12 so that the springs 42 pivot support panel 30 upwardly and press printed item 12 against finger portions 66 of arm portions 64.

A method of turning a page 14, includes the steps of pressing downward on the printed item 12 to pivot support panel 30 downwardly on hinges 24 and free the printed item 12 from arm portions 64; sliding the printed item 12 out from under arm portions 64; turning the page 14; sliding the printed item 12 back underneath arm portions 64; and releasing the downward pressure on the printed item 12 so that springs 42 pivot support panel 30 upwardly on hinges 24 and thereby press the printed item 12 into contact with finger portions 66 of arm portions 64.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A holder apparatus for propping and holding a printed item for viewing, comprising:

a printed item support member having a support member forward edge, a support member rearward edge and a support member upper face;

hinge means;

a base member having a base member forward edge, for resting on an apparatus support surface, wherein said base member forward edge is connected by said hinge means to said support member forward edge;

biasing means extending between said support member and said base member for elevating said support member rearward edge to tilt said support member upper face toward a user of said apparatus;

a post member secured to said base member and extending upwardly behind said support member;

and an anchor arm member slidably mounted on said post member for pressing downwardly against and thereby holding a page of said printed item.

2. The apparatus of claim 1, comprising two said post members and one said anchor arm member slidably mounted on each said post member.

3. The apparatus of claim 1, wherein said arm member comprises an annular portion for slidingly fitting over said post member and an arm portion extending generally radially from said annular portion and over said support member for bearing down against and holding a printed item in place on said support member.

4. The apparatus of claim 1, wherein said arm member has a free end and wherein said free end comprises an anchor arm finger portion protruding downwardly to bear against an open page of said printed item.

5. The apparatus of claim 1, wherein said support member comprises a spring mounting support member peg protruding downwardly and said base member comprises a spring mounting base member peg protruding upwardly, and wherein said biasing means comprises a coil spring having two spring ends, and wherein each said spring end is fitted over one of said peg members.

6. The apparatus of claim 1, additionally comprising a printed item retaining element protruding generally upwardly along said support member forward edge for obstructing said printed item from sliding off said support member.

7. The apparatus of claim 3, wherein said arm member annular portion comprises a radial bore having bore internal threads and a thumb set screw extending engagingly through said radial bore for securing said anchor arm member to said post member after said arm member is positioned by a user.

8. The apparatus of claim 1, wherein said apparatus is made of wood.

9. A method of assembling an apparatus comprising a printed item support member having a support member forward edge, a support member rearward edge and a support member upper face; hinge means; a base member having a base member forward edge, for resting on an apparatus support surface, wherein said base member forward edge is connected by said hinge means to said support member forward edge; biasing means extending between said support member and said base member for elevating said support member rearward edge to tilt said support member upper face toward a user; a post member secured to said base member and extending upwardly behind said support member; and an anchor arm member slidably mounted on said post member for pressing downwardly against and thereby holding a page of said printed item, wherein said support member comprises a spring mounting peg protruding downwardly and said base member comprises a spring mounting peg protruding upwardly, and wherein said biasing means comprises a coil spring having two spring ends, and wherein each said spring end is fitted over one of said peg members, and wherein said arm member comprises an annular portion for slidingly fitting over said post member and an arm portion extending generally radially from said annular portion and over said support member for bearing down against and holding a printed item in place on said support member, and wherein said arm member annular portion comprises a radial bore having bore internal threads and a thumb set screw extending engagingly through said radial bore for securing said anchor arm member to said post member after said arm member is positioned by a user, for storage, comprising the steps of:

loosening said thumb set screws and rotating said arm portions of said arm members off said support member;

pivoting said support member upwardly;

pulling said spring off said support member peg and said base member peg;

laying said spring flat onto said base member;

pivoting said support member downwardly such that said pegs abut said members;

rotating said anchor arm portion over said support member and sliding said anchor arm member downwardly such that said finger portion abuts said support member;

and tightening said thumb set screws such that said finger portions hold said apparatus in a collapsed configuration.

10. A method of disassembling the apparatus of claim 9 for storage and transport, comprising the steps of:

loosening said thumb set screws and rotating said anchor arm portions off said support member;

pivoting said support member upwardly;

fitting one end of said spring onto said base member peg and fitting the other end of said spring onto said support member peg;

sliding said anchor arm member upwardly;

and rotating said arm portion over said support member.

11. A method of using an apparatus comprising a printed item support member having a support member forward edge, a support member rearward edge and a support member upper face; hinge means; a base member having a base member forward edge, for resting on an apparatus support surface, wherein said base member forward edge is connected by said hinge means to said support member forward edge; biasing means extending between said support member and said base member for elevating said support member rearward edge to tilt said support member upper face toward a user; a post member secured to said base member and extending upwardly behind said support member; and an anchor arm member slidably mounted on said post member for pressing downwardly against and thereby holding a page of said printed item, comprising the steps of:

placing a printed item onto said support member;

pressing downward on said printed item to pivot said support member downwardly against the biasing of said biasing means;

sliding said printed item underneath said anchor arm portion;

and releasing said printed item such that said biasing means pivots said support member upwardly and said printed item is pressed against said anchor arm portion.

12. A method of turning a page of a printed item on a printed item holding apparatus comprising a printed item support member having a support member forward edge, a support member rearward edge and a support member upper face; hinge means; a base member having a base member forward edge, for resting on an apparatus support surface, wherein said base member forward edge is connected by said hinge means to said support member forward edge; biasing means extending between said support member and said base member for elevating said support member rearward edge to tilt said support member upper face toward a user; a post member secured to said base member and extending upwardly behind said support member; and an anchor arm member slidably mounted on said post member for pressing downwardly against and thereby holding a page of said printed item, comprising the steps of:

pressing downward on said printed item to pivot said support member downwardly against the biasing of said biasing means and free said printed item from said anchor arm member;

sliding said printed item out from under said anchor arm member;

turning said page;

sliding said printed item back underneath said anchor arm member;

and releasing said downward pressure on said printed item such that said springs push said support member upward and press said printed item into contact with said anchor arm member.

* * * * *